US006067765A

United States Patent [19]

Jones

[11] Patent Number: 6,067,765

[45] Date of Patent: May 30, 2000

[54] INSULATED LAYER OF CONCRETE

[75] Inventor: Thaddeus M. Jones, Bremen, Ind.

[73] Assignee: MSX, Inc., South Bend, Ind.

[21] Appl. No.: 08/804,012

[22] Filed: Feb. 21, 1997

[51] Int. Cl.[7] ..... E04B 1/00

[52] U.S. Cl. ..... 52/309.12; 52/408; 52/309.4; 52/309.13; 52/309.16

[58] Field of Search ..... 52/309.12, 309.4, 52/309.13, 309.16, 677, 396.04, 610, 408, 404, 405.1, 405.4, 309.7, 309.8; 404/73, 82, 44; 428/319.1, 703, 600, 649.1

[56] References Cited

U.S. PATENT DOCUMENTS

| | | | |
|---|---|---|---|
| 3,527,004 | 9/1970 | Sorensen | 52/98 |
| 3,561,175 | 2/1971 | Best et al. | 52/309.4 X |
| 3,839,518 | 10/1974 | Rubens et al. | 404/82 X |
| 3,904,847 | 9/1975 | Adams | 219/213 |
| 4,168,924 | 9/1979 | Draper et al. | 404/82 X |
| 4,232,823 | 11/1980 | Eggermann | 404/82 X |
| 4,274,239 | 6/1981 | Carroll | 52/309.8 X |
| 4,282,697 | 8/1981 | Spielau et al. | 52/309.4 X |
| 4,351,138 | 9/1982 | McMillan et al. | 52/309.4 |
| 4,489,531 | 12/1984 | Nelson | 52/408 |
| 4,500,596 | 2/1985 | Lee | 428/319.1 X |
| 4,579,756 | 4/1986 | Edgel | 52/309.1 X |
| 4,726,973 | 2/1988 | Thompson | 52/98 X |
| 4,825,613 | 5/1989 | Verble | 52/408 |
| 4,846,601 | 7/1989 | Luijten | 404/73 |
| 4,856,930 | 8/1989 | Denning | 404/82 X |
| 4,865,894 | 9/1989 | Shubow | 428/319.1 X |
| 4,915,539 | 4/1990 | Yoshikane et al. | 404/82 X |
| 4,941,770 | 7/1990 | Gemmer | 404/82 X |
| 5,437,924 | 8/1995 | Decker, III et al. | 428/319.1 X |
| 5,440,845 | 8/1995 | Tadros et al. | 52/600 |
| 5,464,303 | 11/1995 | Wells | 404/82 X |
| 5,496,129 | 3/1996 | Dubé | 52/610 X |
| 5,698,601 | 12/1997 | Welte et al. | 428/319.1 X |
| 5,700,385 | 12/1997 | Jones | 52/689 X |
| 5,758,463 | 6/1998 | Mancini, Jr. | 52/309.7 X |
| 5,765,318 | 6/1998 | Michelsen | 52/98 |

*Primary Examiner*—Beth A. Aubrey
*Assistant Examiner*—Brian E. Glessner
*Attorney, Agent, or Firm*—Taylor & Aust, P.C.

[57] ABSTRACT

This invention is directed to an insulated layer of concrete including a plurality of closed cell plastic foam insulating blocks and a layer of concrete covering the blocks. Each block includes a plurality of sides, with each side having a length of between approximately six inches and two feet.

11 Claims, 1 Drawing Sheet

INSULATED LAYER OF CONCRETE

BACKGROUND OF THE INVENTION

1. Field of the Invention

The present invention relates to insulated concrete, and, more particularly, to insulated concrete using a closed cell plastic foam insulation layer.

2. Description of the Related Art

It is known to insulate concrete driveways and walkways by placing a sheet of approximately one inch thick closed cell plastic foam, such as polystyrene or styrofoam (™), between the ground and the concrete. The closed cell plastic foam insulates the concrete from the ground and inhibits the concrete from sweating. The pieces of closed cell plastic foam typically measure approximately 4 feet by 8 feet.

A problem associated with this method is that the pieces of closed cell plastic foam may break under the weight of the concrete or a worker during pouring of the concrete. This breakage typically results in multiple fracture lines running almost the entire length of the sheet, causing the whole board to be damaged or wasted.

Moreover, it is known to heat the concrete to melt and/or inhibit the accumulation of ice and snow thereon. A heater assembly may include a heater wire which is suspended in the layer of concrete using standoffs, reinforcing rod, etc. When using a conventional 4×8 sheet of closed cell plastic foam insulation, the worker first lays down the 4×8 sheet of closed cell plastic foam and then installs the standoffs, rebar and/or heater wire. Since the worker cannot reach to the center of the 4×8 sheets, it is usually necessary for the worker to walk on the 4×8 sheet to install the standoffs, rebar, heater wire, etc., thereby resulting in the above-mentioned breakage of the closed cell plastic foam insulation.

Another disadvantage associated with a worker walking on the closed cell plastic foam insulation is that the insulation is permanently compressed at the impact locations, thereby resulting in a decreased insulating or "R" value. If the concrete layer is heated, this decrease in the insulating value of the closed cell plastic foam insulation may result in additional loss of heat to the ground, thereby reducing the heating efficiency.

Breakage of the conventional 4×8 sheets of closed cell plastic foam insulation is further increased if the ground upon which the insulation is disposed is not perfectly flat. That is, the closed cell plastic foam insulation is a relatively brittle material when subjected to a loading force. If the 4×8 sheet of closed cell plastic foam insulation spans a depression or projection on the ground, it is possible that the weight of the concrete and/or worker will relatively easily break the sheet of insulation.

Another problem is that these large pieces of closed cell plastic foam do not conform well to curves. The closed cell plastic foam has to be cut into smaller pieces to completely cover the area within the boundaries of a curved driveway without the closed cell plastic foam extending beyond the boundaries of the driveway (FIG. 1). This may result in wastage of all of the closed cell plastic foam falling outside the driveway boundaries, as all of this extra closed cell plastic foam must be cut off.

What is needed in the art is a way to insulate a layer of concrete with closed cell plastic foam such that less closed cell plastic foam is wasted due to breakage under the weight of the concrete or a worker during pouring of the concrete, and less closed cell plastic foam is wasted due to being cut to conform to the boundaries of the curves of a driveway.

SUMMARY OF THE INVENTION

The present invention provides a layer of concrete insulated from the ground by closed cell plastic foam blocks having sides with lengths measuring between approximately six inches and two feet.

The invention comprises, in one form thereof, an insulated layer of concrete including a plurality of plastic insulating blocks and a layer of concrete covering the blocks. Each block includes a plurality of sides, with each side having a length of between approximately six inches and two feet.

An advantage of the present invention is that the relatively small pieces of closed cell plastic foam are less likely to break under the weight of the concrete or a worker during pouring of the concrete than four foot by eight foot pieces. The damage is limited and can be repaired.

Another advantage is that the reduction in breakage of the pieces of closed cell plastic foam results in less wastage of the closed cell plastic foam.

Yet another advantage is that it is easier to conform the smaller pieces of closed cell plastic foam to the shape of a driveway having a substantial curve, thereby resulting in less wastage of the closed cell plastic foam.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
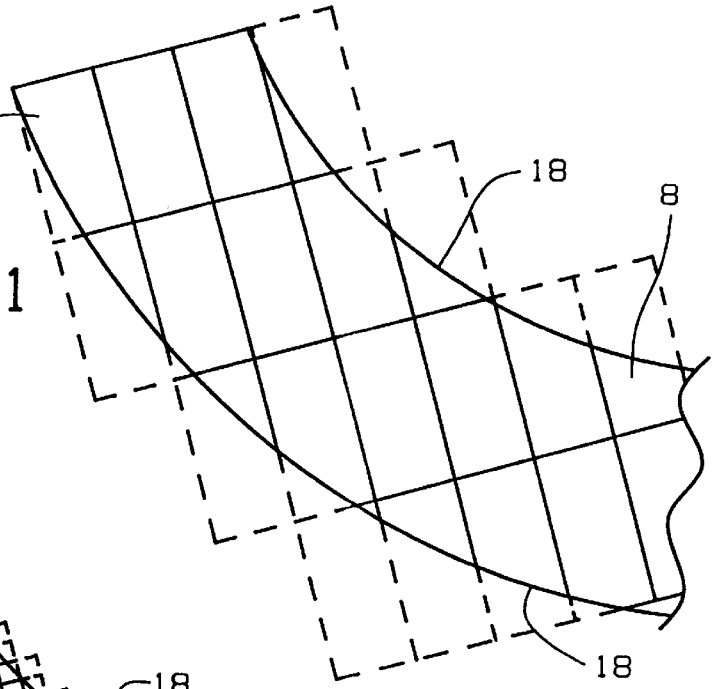
PRIOR ART Fig. 1
FIG. 1 is a top view of conventional four foot by eight foot pieces of closed cell plastic foam with respect to the boundaries of a curved driveway.

Referring now to the drawings, and more particularly to FIG. 1, there is shown a top view of conventional 4 ft.×8 ft.

sheets of closed cell plastic foam insulation 8 with respect to the boundaries of a curved driveway 18. Such a driveway may have a width of between 10 to 12 feet. Accordingly, conventional closed cell plastic foam sheets 8 likely extend well past the boundaries of driveway 18 when laid in a typical side-to-side and end-to-end manner as shown. It is thus necessary to cut off large portions of a number of the closed cell plastic foam sheets 8 to cause sheets 8 to conform to the curved boundaries of driveway 18. Such necessary cutting and trimming when using conventional 4×8 sheets of closed cell plastic foam 8 is labor intensive and results in wastage of closed cell plastic foam sheets 8. Moreover, the conventional 4 ft.×8 ft. closed cell plastic foam sheets 8 are more susceptible to breakage and compaction if the ground under the closed cell plastic foam sheets 8 is uneven and/or it is necessary for the worker to walk thereon.

Figure 2:
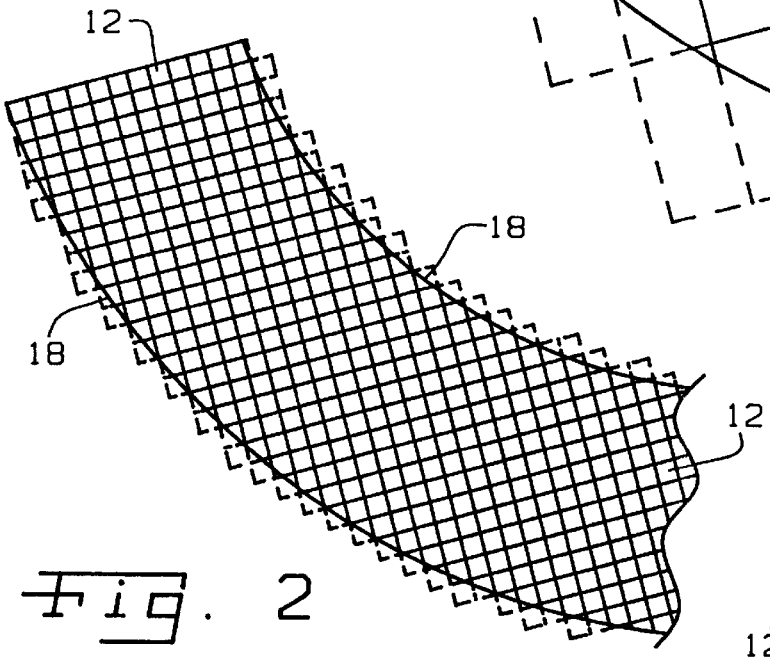
FIG. 2 is a top view of one embodiment of closed cell plastic foam blocks of the present invention, measuring approximately one foot on any side, conforming to the boundaries of a curved driveway.

Referring now to FIG. 2, there is shown an embodiment of an insulating layer of closed cell plastic foam blocks 12 of the present invention conforming to boundaries of curved driveway 18. Closed cell plastic foam blocks 12 are laid out in a side-to-side and end-to-end manner to cover the entire area of driveway. Blocks 12 are laid very closely together or even touching to minimize the area of uncovered ground. Since driveway 18 is curved, some portions of closed cell plastic foam blocks 12 extend past the boundaries of the driveway. However, as is apparent, closed cell plastic foam blocks 12 may be arranged to substantially cover the area of curved driveway 18 with very little closed cell plastic foam extending past the boundaries of driveway 18 when compared with closed cell plastic foam sheet 8 shown in FIG. 1. Each block 12 measures approximately one foot on a side with a thickness of approximately one inch in the embodiment shown. However, it is to be understood that blocks 12 can have sides of any length between approximately six inches and two feet. Closed cell plastic foam blocks 12 insulate concrete 14 from both moisture absorption from and heat loss to ground 16.

Figure 4:
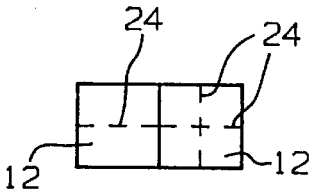
FIG. 4 is a top view of two of the closed cell plastic foam blocks shown in FIGS. 2 and 3 with optional perforated score lines.
Figure 3:
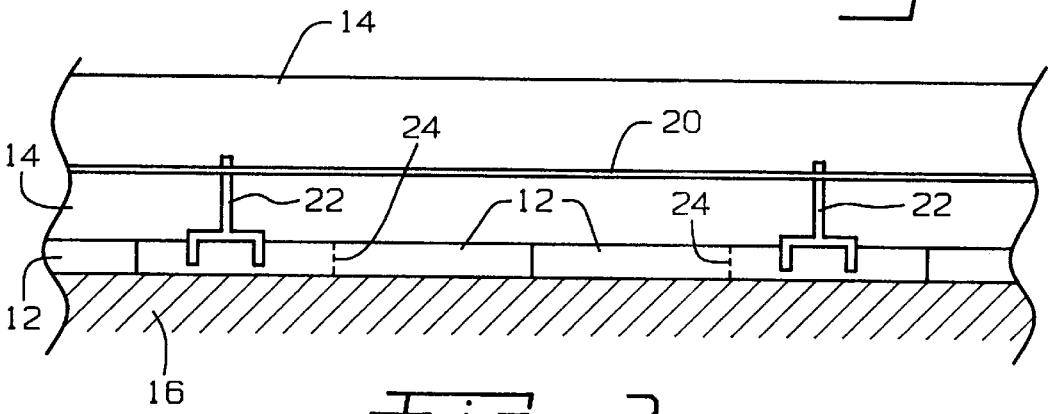
FIG. 3 is a side view of one embodiment of an insulated layer of concrete of the present invention including the insulating layer of closed cell plastic foam blocks shown in FIG. 2.

Referring now to FIG. 3, an embodiment of an insulated layer of concrete of the present invention is shown. A layer of concrete 14 is disposed above the layer of closed cell plastic foam blocks 12 which are laid on ground 16. Blocks 12 may include one or more optional perforated score lines 24 allowing blocks 12 to be broken into smaller pieces (FIGS. 3 and 4). Layer of concrete 14 is approximately four to six inches thick and may be composed of an aggregate of cement, sand and/or gravel. Layer of concrete 14 is heated in the embodiment shown using a heater wire 20 which is suspended therein. Heater wire 20 is suspended within concrete 14 using rebar (not shown) or standoffs 22. Standoffs 22 include legs which are inserted into closed cell plastic foam blocks 12 and an upstanding portion to which heater wire 20 is fastened using cable ties, integral clips, etc.

During installation, closed cell plastic foam blocks 12 are laid on ground 16 in a side-to-side and end-to-end manner as shown in FIG. 2. Because of the relatively small size of closed cell plastic foam blocks 12, they are capable of better conforming to unevenness of ground 16, and are thus less susceptible of breakage under the weight of the concrete and/or a worker. As the rows of blocks 12 are laid down onto ground 16, a user easily reaches to any portion of the just laid row of blocks 12 to install standoffs, rebar, heater wire, etc. It is thus unnecessary for the user to walk on blocks 12, which in turn reduces breakage and compaction of blocks 12. At the edges of a curved driveway 18 or other physical boundary of the concrete layer, the worker simply trims off small pieces of blocks 12 to conform to the curved boundary of driveway 18. Alternatively, given the relative small size of blocks 12, a worker may elect to simply leave small portions at the edge of the driveway uninsulated, depending upon the particular application. Moreover, if blocks 12 include optional perforated score lines 24, the user may simply break off a portion of a block 12 to cause a particular block 12 to better conform to the curved boundary of driveway 18. After blocks 12, standoffs 22, rebar (not shown) and/or heater wire 20 are installed within the curved driveway 18, the layer of concrete 14 is poured thereover in known manner.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pathway structure for supporting at least one of a person, an animal and a vehicle in traversing a ground surface, said pathway structure comprising:

a plurality of closed cell plastic foam insulating blocks, each said block including a plurality of sides and a bottom face, said bottom face being configured for at least indirectly contacting the ground surface, said blocks being disposed substantially side-by-side relative to each other in a direction substantially parallel to the ground surface, each said side having a length of between approximately six inches and two feet;

a layer of concrete covering and in direct contact with said blocks, said layer of concrete being substantially parallel to the ground surface and configured for supporting the at least one of a person, an animal and a vehicle in traversing the ground surface; and at least one heater wire disposed within said layer of concrete.

2. The insulated layer of concrete of claim 1, wherein each said side has a length of approximately one foot.

3. The insulated layer of concrete of claim 1, wherein each said block has a thickness of approximately one inch.

4. The insulated layer of concrete of claim 1, wherein said layer of concrete has a thickness of between approximately three and six inches.

5. The insulated layer of concrete of claim 1, wherein said plastic comprises polystyrene.

6. The insulated layer of concrete of claim 1, wherein said sides are each approximately the same length.

7. An insulated layer of concrete, comprising:

a plurality of insulating blocks, each said insulating block being formed of a closed cell plastic foam material, each said block including a plurality of sides, said blocks being disposed substantially side-by-side relative to each other, each said side having a length of between approximately six inches and two feet, each said block including at least one perforated score line extending substantially through said closed cell plastic foam material in a direction substantially parallel to each said side; and a layer of concrete covering said blocks.

8. The insulated layer of concrete of claim 7, wherein said at least one perforated score line includes a plurality of aligned holes.

9. The insulated layer of concrete of claim 1, wherein said closed cell plastic foam insulating blocks consist essentially of plastic foam.

10. A method of supporting at least one of a person, an animal and a vehicle in traversing a ground surface, said method comprising the steps of:

supporting a plurality of closed cell plastic foam insulating blocks with a ground surface, each said block including a plurality of sides, said blocks being disposed substantially side-by-side relative to each other, each said side having a length of between approximately six inches and two feet;

covering said blocks with a layer of concrete, said layer of concrete being substantially parallel to the ground surface; and transporting the one of a person, an animal and a vehicle over said layer of concrete such that said layer of concrete supports the one of a person, an animal and a vehicle.

11. The method of claim 10, comprising the further step of suspending at least one heater wire within said layer of concrete.

* * * * *